US007491057B2

(12) United States Patent
Saijo et al.

(10) Patent No.: US 7,491,057 B2
(45) Date of Patent: Feb. 17, 2009

(54) FIRING FURNACE, MANUFACTURING METHOD OF A CERAMIC MEMBER USING THE FIRING FURNACE, CERAMIC MEMBER, AND CERAMIC HONEYCOMB FILTER

(75) Inventors: Takamitsu Saijo, Ibi-gun (JP); Yuichi Hiroshima, Ibi-gun (JP); Koji Higuchi, Ibi-gun (JP)

(73) Assignee: Ibiden Co., Ltd., Ogaki-shi (JP)

( * ) Notice: Subject to any disclaimer, the term of this patent is extended or adjusted under 35 U.S.C. 154(b) by 421 days.

(21) Appl. No.: 11/174,483

(22) Filed: Jul. 6, 2005

(65) Prior Publication Data

US 2007/0202455 A1 Aug. 30, 2007

(30) Foreign Application Priority Data

Aug. 10, 2004 (JP) ..... 2004-233626
Feb. 18, 2005 (WO) ..... PCT/JP2005/002626

(51) Int. Cl.
*F27B 11/00* (2006.01)

(52) U.S. Cl. ..... 432/206; 432/9; 432/247

(58) Field of Classification Search ..... 432/9, 432/206, 247, 121, 128, 132, 143, 146; 264/828, 264/629, 630
See application file for complete search history.

(56) References Cited

U.S. PATENT DOCUMENTS 4,325,694 A 4/1982 Bergman
4,850,576 A 7/1989 Hack et al.
5,292,460 A * 3/1994 Kyutoku et al. ..... 264/29.5
5,474,613 A * 12/1995 Pickering et al. ..... 118/725
5,914,187 A 6/1999 Naruse et al.
5,930,994 A 8/1999 Shimato et al.
6,447,564 B1 9/2002 Ohno et al.
6,565,630 B2 5/2003 Ohno et al.
6,669,751 B1 12/2003 Ohno et al.
6,770,116 B2 8/2004 Kojima (Continued)

FOREIGN PATENT DOCUMENTS

JP 62-8409 1/1987

(Continued)

OTHER PUBLICATIONS

U.S. Appl. No. 11/696,976.

(Continued)

*Primary Examiner*—Gregory A Wilson
(74) *Attorney, Agent, or Firm*—Oblon, Spivak, McClelland, Maier & Neustadt, P.C.

(57) ABSTRACT

A manufacturing method for producing a ceramic member by firing a formed body with a firing furnace. The firing furnace is equipped with 1) a muffle formed in a manner so as to ensure a space for housing the formed body to be fired; 2) a heater or a heat generator serving as the heater, which is placed outside the muffle; and 3) a plurality of heat insulating layers made of carbon, fixed by stoppers made of carbon, and formed in a manner so as to enclose the heater or the heat generator. The method fires the formed body with the firing furnace to form the ceramic member, and heats the muffle and the space for housing the formed body with the heater or the heat generator.

8 Claims, 4 Drawing Sheets

U.S. PATENT DOCUMENTS

| | | | | |
|---|---|---|---|---|
| 2004/0009865 | A1* | 1/2004 | Nair et al. | 501/97.1 |
| 2004/0031264 | A1 | 2/2004 | Kojima | |
| 2004/0033175 | A1 | 2/2004 | Ohno et al. | |
| 2004/0051196 | A1* | 3/2004 | Otsuka et al. | 264/630 |
| 2004/0055265 | A1 | 3/2004 | Ohno et al. | |
| 2004/0161596 | A1 | 8/2004 | Taoka et al. | |
| 2004/0223892 | A1 | 11/2004 | Kojima | |
| 2005/0011174 | A1 | 1/2005 | Hong et al. | |
| 2005/0016140 | A1 | 1/2005 | Komori et al. | |
| 2005/0016141 | A1 | 1/2005 | Hong et al. | |
| 2005/0076626 | A1 | 4/2005 | Kudo et al. | |
| 2005/0102987 | A1 | 5/2005 | Kudo | |
| 2005/0109023 | A1 | 5/2005 | Kudo et al. | |
| 2005/0115224 | A1 | 6/2005 | Kojima | |
| 2005/0153099 | A1 | 7/2005 | Yamada | |
| 2005/0159310 | A1 | 7/2005 | Ohno et al. | |
| 2005/0161849 | A1 | 7/2005 | Ohno et al. | |
| 2005/0169818 | A1 | 8/2005 | Ohno et al. | |
| 2005/0169819 | A1 | 8/2005 | Shibata | |
| 2005/0175514 | A1 | 8/2005 | Ohno | |
| 2005/0176581 | A1 | 8/2005 | Ohno et al. | |
| 2005/0178098 | A1 | 8/2005 | Ono et al. | |
| 2005/0180898 | A1 | 8/2005 | Yamada | |
| 2005/0214504 | A1 | 9/2005 | Yoshida | |
| 2005/0229565 | A1 | 10/2005 | Yoshida | |
| 2005/0247038 | A1 | 11/2005 | Takahashi | |
| 2005/0272602 | A1 | 12/2005 | Ninomiya | |
| 2006/0019061 | A1 | 1/2006 | Oshimi | |
| 2006/0029897 | A1 | 2/2006 | Saijo et al. | |
| 2006/0029898 | A1* | 2/2006 | Saijo et al. | 432/247 |
| 2006/0043652 | A1 | 3/2006 | Saijo et al. | |
| 2006/0059877 | A1 | 3/2006 | Yoshida | |
| 2006/0108347 | A1 | 5/2006 | Koyama et al. | |
| 2006/0118546 | A1 | 6/2006 | Saijo | |
| 2006/0245465 | A1 | 11/2006 | Saijo et al. | |
| 2007/0175060 | A1 | 8/2007 | Idei et al. | |
| 2007/0199205 | A1 | 8/2007 | Hoshino et al. | |
| 2007/0202455 | A1 | 8/2007 | Saijo et al. | |

FOREIGN PATENT DOCUMENTS

| | | |
|---|---|---|
| JP | 63-302291 | 12/1988 |
| JP | 63-302292 | 12/1988 |
| JP | 1-167584 | 7/1989 |
| JP | 1-118213 | 8/1989 |
| JP | 10-141859 | 5/1998 |
| JP | 10-238961 | 9/1998 |
| JP | 2001-48657 | 2/2001 |
| JP | 2002-20174 | 1/2002 |

OTHER PUBLICATIONS

U.S. Appl. No. 11/749,961.
U.S. Appl. No. 11/748,099.
U.S. Appl. No. 11/746,895.
U.S. Appl. No. 11/513,115.
U.S. Appl. No. 11/762,928.
U.S. Appl. No. 11/765,088.
U.S. Appl. No. 09/926,795.
U.S. Appl. No. 10/129,126.
U.S. Appl. No. 10/506,438, filed Mar. 22, 2005, Taoka et al.
U.S. Appl. No. 10/502,044, filed Jan. 24, 2005, Taoka et al.
U.S. Appl. No. 10/513,798, filed Nov. 18, 2004, Kunieda et al.
U.S. Appl. No. 10/515,179, filed Jul. 19, 2005, Yamada.
U.S. Appl. No. 10/515,181, filed Nov. 26, 2004, Komori et al.
U.S. Appl. No. 10/514,560, filed Jun. 29, 3005, Ohno et al.
U.S. Appl. No. 10/516,328, filed Dec. 14, 2004, Komori et al.
U.S. Appl. No. 10/518,373, filed Dec. 28, 2004, Ohno et al.
U.S. Appl. No. 10/518,548, filed Jan. 3, 2005, Takahashi.
U.S. Appl. No. 10/521,592, filed Jan. 12, 2005, Ohno et al.
U.S. Appl. No. 11/145,986, field Jun. 7, 2005, Saijo et al.
U.S. Appl. No. 11/174,483, filed Jul. 6, 2005, Saijo et al.
U.S. Appl. No. 11/225,197.
U.S. Appl. No. 10/527,531, filed Mar. 11, 2005, Ogyu et al.
U.S. Appl. No. 10/530,561, filed Apr. 7, 2005, Komori et al.
U.S. Appl. No. 11/174,726, filed Jul. 6, 2005, Ohno et al.
U.S. Appl. No. 11/541,724.
U.S. Appl. No. 11/546,417.
U.S. Appl. No. 11/604,682.
U.S. Appl. No. 11/606,167.
U.S. Appl. No. 11/636,460.
U.S. Appl. No. 11/638,433.
U.S. Appl. No. 11/645,544.

* cited by examiner

Cross-section on B-B line

FIRING FURNACE, MANUFACTURING METHOD OF A CERAMIC MEMBER USING THE FIRING FURNACE, CERAMIC MEMBER, AND CERAMIC HONEYCOMB FILTER

CROSS-REFERENCE TO RELATED APPLICATIONS

This application claims benefit of priority to Japanese Patent Application No. 2004-233626, filed on Aug. 10, 2004, and PCT application PCT/JP2005/002626, filed on Feb. 18, 2005.

The contents of those applications are incorporated by reference herein in their entirety.

BACKGROUND OF THE INVENTION

1. Field of the Invention

The present invention relates to a firing furnace, a manufacturing method of a ceramic member using this firing furnace, a ceramic member, and a ceramic honeycomb filter.

2. Discussion of the Background

There have been proposed various exhaust-gas purifying honeycomb filters and catalyst supporting bodies which are used for purifying exhaust gases discharged from internal combustion engines of vehicles, such as a bus, a truck and the like, construction machines and the like.

With respect to such an exhaust-gas purifying honeycomb filter or the like, there has been used a honeycomb structural body made of a non-oxide ceramic porous material such as silicon carbide having superior heat resistance.

Conventionally, for example, Japanese Patent Laid-open Publication No. 2001-48657 and Japanese Patent Laid-open Publication No. 63-302291 (1988) have disclosed firing furnaces for manufacturing the non-oxide ceramic member of this type.

The firing furnace for manufacturing the non-oxide ceramic member of this type or the like is provided with a muffle, a heater and the like that are installed in the furnace, and a heat insulating layer made of a heat insulating member that is placed so as to enclose the muffle and the heater.

In the firing furnace of this type, the heat insulating layer is constituted by a plurality of layers, and these heat insulating layers are fixed by stoppers. These stoppers are made of, for example, carbon that is superior in heat resistance. With respect to the heat insulating layer, the inner layer is made of carbon that is superior in high-temperature heat resistance, while the outermost layer is made of a material other than carbon since the temperature thereof is lower than that of the inner layer. In many cases, this layer is prepared as, for example, a layer made of ceramic fibers such as alumina fibers or the like (hereinafter, referred to as ceramic fiber layer).

The contents of Japanese Patent Laid-open Publication No. 2001-48657 and Japanese Patent Laid-open Publication No. 1988-302291 are incorporated herein by reference in their entirety.

SUMMARY OF THE INVENTION

A firing furnace according to the present invention comprises: a muffle formed in a manner so as to ensure a space for housing a formed body to be fired; a heater or a heat generator serving as the heater, placed outside the muffle; and a plurality of heat insulating layers formed in a manner so as to enclose the muffle and the heater therein.

Herein, the heat insulating layers are made of carbon and fixed by stoppers made of carbon.

In the firing furnace, any one layer of the heat insulating layers is desirably prepared as a carbon fiber layer.

Moreover, the outermost layer of the heat insulating layers is desirably prepared as a carbon fiber layer.

Moreover, each of the heat insulating layers desirably comprises three heat insulating layers. The outermost layer of the heat insulating layer desirably comprises a carbon heat insulating layer and a carbon fiber layer. The carbon heat insulating layer desirably has a density of at least about 0.1 g/cm$^3$ and at most about 5 g/cm$^3$ and a thickness of at least about 5 mm and at most about 100 mm. The carbon fiber layer desirably has a density of at least about 0.05 g/cm$^3$ and at most about 5 g/cm$^3$ and a thickness of at least about 1 mm and at most about 100 mm.

A manufacturing method of a ceramic member according to the present invention is the method, upon firing a formed body to form the ceramic member, using a firing furnace that comprises: a muffle formed in a manner so as to ensure a space for housing a formed body to be fired; a heater or a heat generator serving as the heater, placed outside the muffle, and a plurality of heat insulating layers that are formed in a manner so as to enclose the muffle and the heater therein.

Herein, the heat insulating layers are made of carbon, and are fixed by stoppers made of carbon.

In the manufacturing method of the ceramic member, the ceramic member is desirably made of a porous ceramic member, and the firing furnace is desirably designed so that any one layer of the heat insulating layers is prepared as a carbon fiber layer. The firing furnace is desirably designed so that a carbon fiber layer is formed as the outer most layer of the heat insulating layers.

Moreover, the firing furnace is desirably designed so that each of the heat insulating layers comprises three heat insulating layers, and the outermost layer of the heat insulating layer comprises a carbon heat insulating and a carbon fiber layer. The firing furnace is desirably designed so that the carbon heat insulating layer has a density of at least about 0.1 g/cm$^3$ and at most about 5 g/cm$^3$ and a thickness of at least about 5 mm and at most about 100 mm, and the carbon fiber layer has a density of at least about 0.05 g/cm$^3$ and at most about 5 g/cm$^3$ and a thickness of at least about 1 mm and at most about 100 mm.

A ceramic member according to the present invention is the ceramic member manufactured by firing a formed body, upon firing the formed body, being manufactured by using a firing furnace that comprises: a muffle formed in a manner so as to ensure a space for housing a formed body to be fired; a heater or a heat generator serving as the heater, placed outside the muffle; and a plurality of heat insulating layers that are formed in a manner so as to enclose the muffle and the heater therein.

Herein, the heat insulating layers are made of carbon, and are fixed by stoppers made of carbon.

The ceramic member is desirably made of a porous ceramic member, and in ceramic member, the firing furnace is desirably designed so that any one layer of the heat insulating layers is prepared as a carbon fiber layer. The firing furnace is desirably designed so that a carbon fiber layer is formed as the outermost layer of the heat insulating layers.

Moreover, the firing furnace is desirably designed so that each of the heat insulating layers comprises three heat insulating layers, and the outermost layer of the heat insulating layer comprises a carbon heat insulating and a carbon fiber layer.

A ceramic honeycomb filter according to the present invention is the filter being obtained by using the ceramic member of the present invention.

In the ceramic honeycomb filter, the ceramic is desirably made of a porous ceramic member.

In the ceramic honeycomb filter, the firing furnace is desirably designed so that any one layer of the heat insulating layers is prepared as a carbon fiber layer. The firing furnace is desirably designed so that a carbon fiber layer is formed as the outermost layer of the heat insulating layers.

Moreover, the firing furnace is desirably designed so that each of the heat insulating layers comprises three heat insulating layers, and the outermost layer of the heat insulating layer comprises a carbon heat insulating and a carbon fiber layer.

BRIEF DESCRIPTIONS OF THE DRAWINGS

DESCRIPTION OF THE EMBODIMENTS

A firing furnace according to the present invention comprises a muffle formed in a manner so as to ensure a space for housing a formed body to be fired, a heater or a heat generator serving as the heater, placed outside the muffle, and a plurality of heat insulating layers formed in a manner so as to enclose the muffle and the heater therein.

Herein, the heat insulating layers are made of carbon and fixed by stoppers made of carbon.

Figure 1:
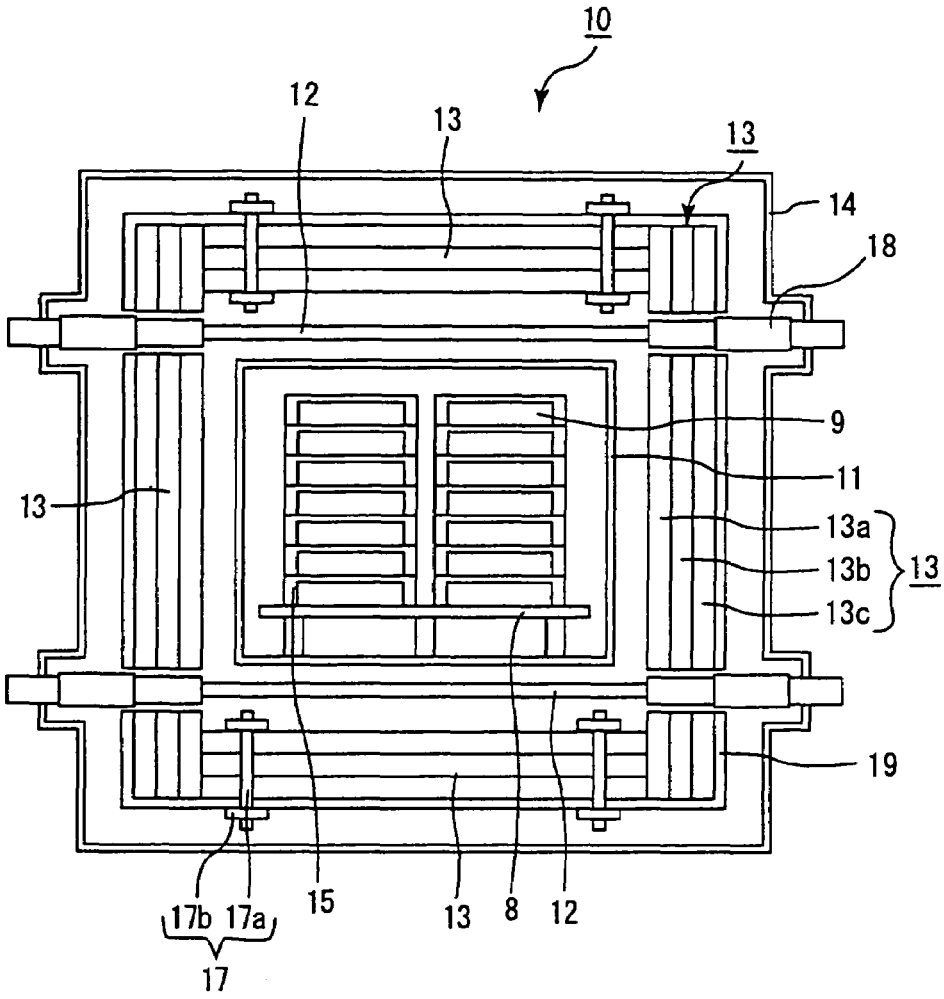
FIG. 1 is a cross-sectional view that schematically shows one example of a firing furnace according to the present invention.
Figure 2:
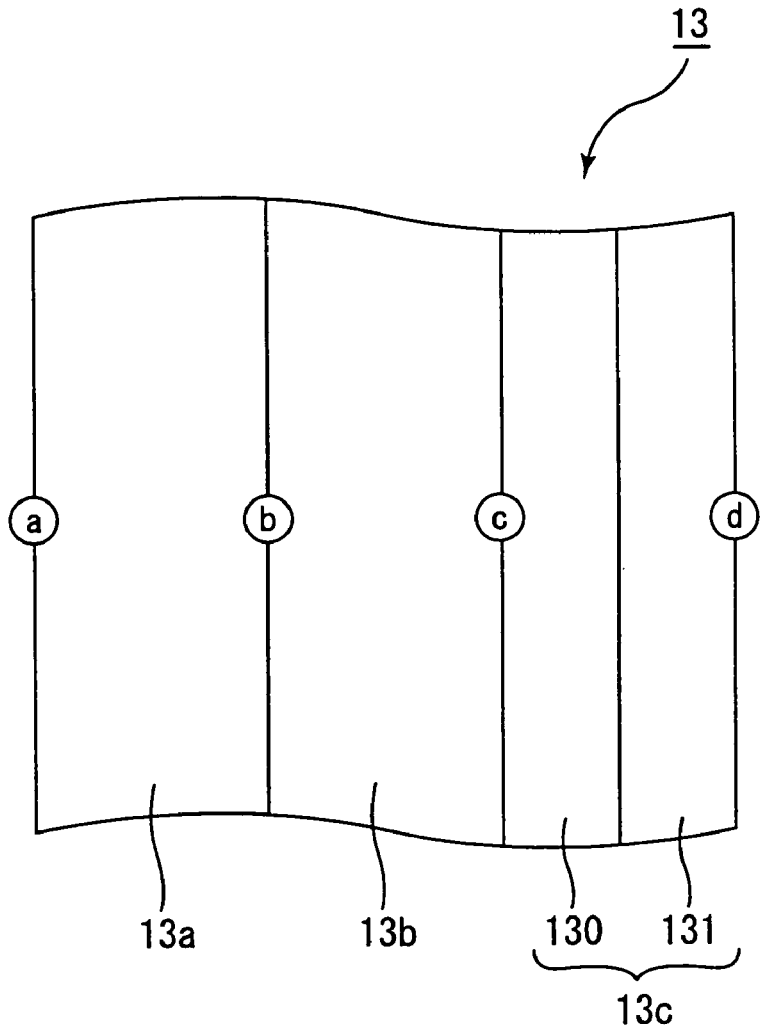
FIG. 2 is a cross-sectional view that schematically shows a heat insulating layer portion forming the firing furnace shown in FIG. 1.

FIG. 1 is a cross-sectional view that schematically shows the firing furnace according to the present invention, and FIG. 2 is a cross-sectional view that schematically shows heat insulating layers forming the firing furnace shown in FIG. 1.

The firing furnace 10 according to the present invention comprises a muffle 11 formed in a manner so as to ensure a space for housing a formed body to be fired, a heater 12 placed on the periphery of the muffle 11, heat insulating layers 13 placed outside the muffle 11 and the heater 12, and a heat insulating layer attaching-surrounding member 19 placed on the periphery of the heat insulating layers 13 and used for fixing the heat insulating layers 13, and a furnace wall 14, made of metal or the like, is formed on the outermost side thereof so as to separate the furnace from the ambient atmosphere. Here, the heat insulating layers 13 are fixed onto the heat insulating layer attaching-surrounding member 19 by using stoppers 17 (bolts 17*a* and nuts 17*b*) made of carbon.

The furnace wall 14 may be a water-cooling jacket in which water is circulated, and the heaters 12 may be placed above and below the muffle 11 or may be placed right and left sides of the muffle 11.

The entire floor portion of the muffle 11 is supported by a supporting member (not shown) so that a piled-up body of jigs-for-firing 15 in which formed bodies to be fired are placed is allowed to pass through it. The heaters 12, made of graphite or the like, are placed on the periphery of the muffle 11, and the heaters 12 are connected to an external power supply (not shown) through terminals 18.

The heat insulating layers 13 are provided further outside the heaters 12 and, as shown in FIG. 2, the heat insulating layers 13 are constituted by: two layers made of carbon members 13*a*, 13*b* placed inside; and a layer formed by a carbon heat insulating layer 130 and a carbon fiber layer 131, placed as the outermost layer. In the figure, symbols "a" to "d" are used for indicating temperatures at the respective positions.

Conventionally, the outermost layer of the heat insulating layers 13 was constituted by a ceramic fiber layer so that when a portion "c" had a temperature rise, it reacted with the stoppers 17 used for fixing the heat insulating layers 13 to cause broken stoppers 17 and the subsequent degradation in the functions as the heat insulating layers and deformation thereof, resulting in a reaction with the inner heat insulating layers; however, in the present invention, since the plurality of heat insulating layers and the stoppers 17 used for fixing the heat insulating layers are made of carbon, it is possible to prevent the reaction between the heat insulating layers and the stoppers 17. Moreover, the outermost layer 13*c* is constituted by the carbon heat insulating layer 130 and the carbon fiber layer 131 made of carbon, with the carbon heat insulating layer 130 made of carbon located on the inner side; therefore, it is considered that, even when the temperature of the portion "c" is raised, the carbon heat insulating layer 130 is prevented: from reacting with the heat insulating layer 13*b* located further inside thereof; and also from generating a gap between the heat insulating layer 13*b* and the heat insulating layer 13*c* to split these into two pieces. Here, the structures of the layers made of the carbon members 13*a*, 13*b* are not particularly limited as long as they are formed by carbon as a constituent material; however, examples of the materials thereof includes: the materials constituting the carbon heat insulating layer 130 and the carbon fiber layer 131 exemplified in the following.

Moreover, since the carbon heat insulating layer 130 and the carbon fiber layer 131 have a sufficiently superior heat insulating performance, it is possible to suppress a temperature rise at a portion "d" even when the temperature at the portion "c" is slightly raised; thus, the heat insulating layers 13 are allowed to maintain a sufficiently high heat insulating performance as a whole so that a firing furnace having superior durability and thermal efficiency is achieved.

The carbon heat insulating layer 130 refers to a plate-shaped layer formed by compression-forming of carbon fibers, and its density is preferably set in a range from about 0.1 to about 5 g/cm$^3$. The thickness of the carbon heat insulating layer is desirably set in a range from about 5 to about 100 mm.

The carbon fiber layer 131 refers to a layer formed by paper-making process of carbon fibers or weaving of carbon fibers, such as carbon felt and carbon cloth, and with respect to the products obtained through paper-making process, the sheet shape is prepared by bonding carbon fibers to one another using an inorganic bonding material or the like. The density of the carbon fiber layer is preferably set in a range from about 0.05 to about 5 g/cm$^3$. Moreover, the thickness of the carbon fiber layer is desirably set in a range from about 1 to about 100 mm, more desirably from about 5 to about 50 mm.

The heat insulating layer shown in FIG. 2 is constituted by three heat insulating layers, and the outermost heat insulating layer 13*c* is constituted by the carbon heat insulating layer 130 and the carbon fiber layer 131. With respect to the heat insulating layer 13*c* serving as the outermost layer, either one of the carbon heat insulating layer 130 or the carbon fiber layer 131 may be placed on the outermost side, and only either one of these layers may be used as the outermost heat insulating layer. Here, the heat insulating layer 130 and the carbon fiber layer 131 may be used as the inside carbon members 13*a*, 13*b*.

Here, upon comparing the heat insulating performances between the carbon heat insulating layer 130 and the carbon fiber layer 131, in a low temperature area below about 1200 to about 1300° C., the carbon fiber layer 131 having a lower density normally tends to have a reduced thermal conductivity to exert a superior heat insulating property so that the carbon fiber layer 131 is desirably placed as the outermost layer that forms a low temperature area below about 1200 to about 1300° C. Moreover, since the carbon fiber layer 131 has a high specific surface area and exerts high reactivity to SiO gas and the like to be generated, this layer is desirably used not as the layer on the innermost side, but as the layer on the second or later position, even when the carbon fiber layer 131 is used as a layer other than the outermost layer.

In contrast, since the carbon heat insulating layer 130 has a higher density in comparison with the carbon fiber layer 131, the carbon heat insulating layer 130 is desirably placed on a high-temperature area (inside the furnace) that is exposed to high radiation.

Not limited to three layers, the heat insulating layers 13 may be constituted by two layers or four layers, as long as it is constituted by a plurality of layers; however, it is desirably constituted by three layers so as to ensure heat insulation for maintaining a furnace temperature of about 1400° C. or more and also to reduce the maintenance cost upon exchanging the heat insulating members.

The thermal conductivity of the carbon fiber layer 131 is preferably set in a range from about 0.2 to about 1.6 $Wm^{-1}K^{-1}$, more preferably from about 0.2 to about 1.0 $Wm^{-1}K^{-1}$, within a temperature range from about 100 to about 2000° C.

In the present invention, the material for the heat insulating layers 13 and the stoppers 17 used for fixing the heat insulating layer is desirably made of carbon, although another material that hardly reacts with carbon may partially contained therein. Thus, it becomes possible to effectively prevent reactions between the heat insulating layer and the stoppers 17.

The carbon heat insulating layer 130, the carbon fiber layer 131 and the carbon members 13*a*, 13*b*, constituting the heat insulating layer, and the stoppers 17, which are made of carbon materials, are desirably formed by high-purity carbon. For example, the concentration of impurities in the carbon material is desirably set to about 0.1% by weight or less, more desirably about 0.01% by weight or less.

The atmosphere of the firing furnace 10 is desirably prepared as an inert gas atmosphere, more desirably an argon gas atmosphere, a nitrogen gas atmosphere or the like.

Normally, as shown in FIG. 1, a plurality of formed bodies (ceramic formed bodies) 9 to form porous ceramic members are placed inside a jig-for-firing 15, and these jigs-for-firing 15, each having such formed bodies 9 placed therein, are piled up in a plurality of stages to form a piled-up body, and the supporting base 19 on which the piled-up bodies are placed is transported into a firing furnace 10, and subjected to a firing process while being allowed to pass through it at a predetermined speed. Here, the formed bodies 9 are those which have been subjected to a degreasing process to eliminate the resin and the like therefrom.

The firing furnace 10 has a structure in that heaters 12 are placed above and below the muffle 11 with a predetermined gap, and the temperature of the jig-for-firing 15 is gradually raised by heat from the heaters 12 while it is passing through the firing furnace 10, and after having reached to the maximum temperature, the temperature is gradually lowered; thus, the supporting base 19 on which the piled-up body of jigs-for-firing 15 is placed is continuously transported into the firing furnace 10 from the inlet, and after having been sintered during the passage through it at a predetermined speed, the jigs-for-firing 15 the temperature of which has been lowered is taken out of the outlet so that a porous ceramic member is manufactured.

Here, with respect to the heater to be used for firing, not limited to the structure that carbon members are connected to an external power supply and allowed to heat an object to be heated by directly applying an electric current thereto, another structure may be used in which a heat generator, which serves as a heater, is used so that the heat generator, which is allowed to serve as the heater through an induction heating system, heats the object to be heated. In other words, a structure may be adopted in which a carbon member, which compatibly serves as a heater and a muffle, is placed near the object to be heated and, for example, a heat insulating layer is placed immediately outside the carbon member with a coil placed outside thereof, and by applying an alternating current to the coil, the carbon member is allowed to generate an eddy current so that the temperature of the carbon member is raised to heat the object to be heated.

According to the firing furnace of the present invention, the plurality of heat insulating layers and the stoppers used for fixing the heat insulating layers are made of carbon; therefore, different from the conventional structure, it becomes possible to prevent the stoppers and a part of the heat insulating layers (layer made of ceramic fibers) from reacting with each other, and consequently to prevent cracks and the like in the stoppers as well as damages to the heat insulating layers.

Since the above-mentioned composite layer has a sufficient heat insulating performance, the heat insulating layers are allowed to maintain a sufficiently high heat insulating performance as a whole so that a firing furnace that is superior in durability and thermal efficiency is achieved.

In the concrete embodiment of the present invention, although, upon manufacturing a porous ceramic member made of silicon carbide by using the above-mentioned firing furnace, a formed body that has been degreased is heated and fired at a high temperature of about 1400° C. or more, residual oxygen inside the firing furnace and oxygen, SiO gas and the like generated from the formed body do not react with the heat insulating layer. Therefore, degradation in the heat insulating property of the heat insulating layer is prevented.

The heat insulating property of the heat insulating layer is not lowered; therefore, the temperature of the outermost layer is not raised, the ceramic fibers are not softened and deformed, and degradation in functions as the heat insulating layer is prevented. Moreover, the ceramic fibers do not react with the stoppers used for fixing the ceramic fibers and heat insulating layers. Consequently cracks in the stoppers, a breakage of heat insulating layer into two pieces, and flaking off of the heat insulating layer are prevented.

With respect to ceramic members to be fired by the above-mentioned furnace, not particularly limited, examples thereof include nitride ceramics, carbide ceramics and the like, and the firing furnace of the present invention is suitably applied to a manufacturing process of a non-oxide type ceramic member, in particular, to a manufacturing process of a non-oxide type porous ceramic member.

Description will be briefly given of the manufacturing method of the ceramic member of the present invention by exemplifying a manufacturing method of a non-oxide type porous ceramic member (hereinafter, simply referred to as honeycomb structural body) having a honeycomb structure formed by using the firing furnace, including the firing process thereof. Here, the ceramic member to be formed by the manufacturing method of the ceramic member of the present invention is not intended to be limited by the above-mentioned honeycomb structural body.

The honeycomb structural body has a structure that a plurality of pillar-shaped porous ceramic members, each having a number of through holes that are placed in parallel with one another in the length direction with a wall portion interposed therebetween, are bound to one another through a sealing material layer.

Figure 3:
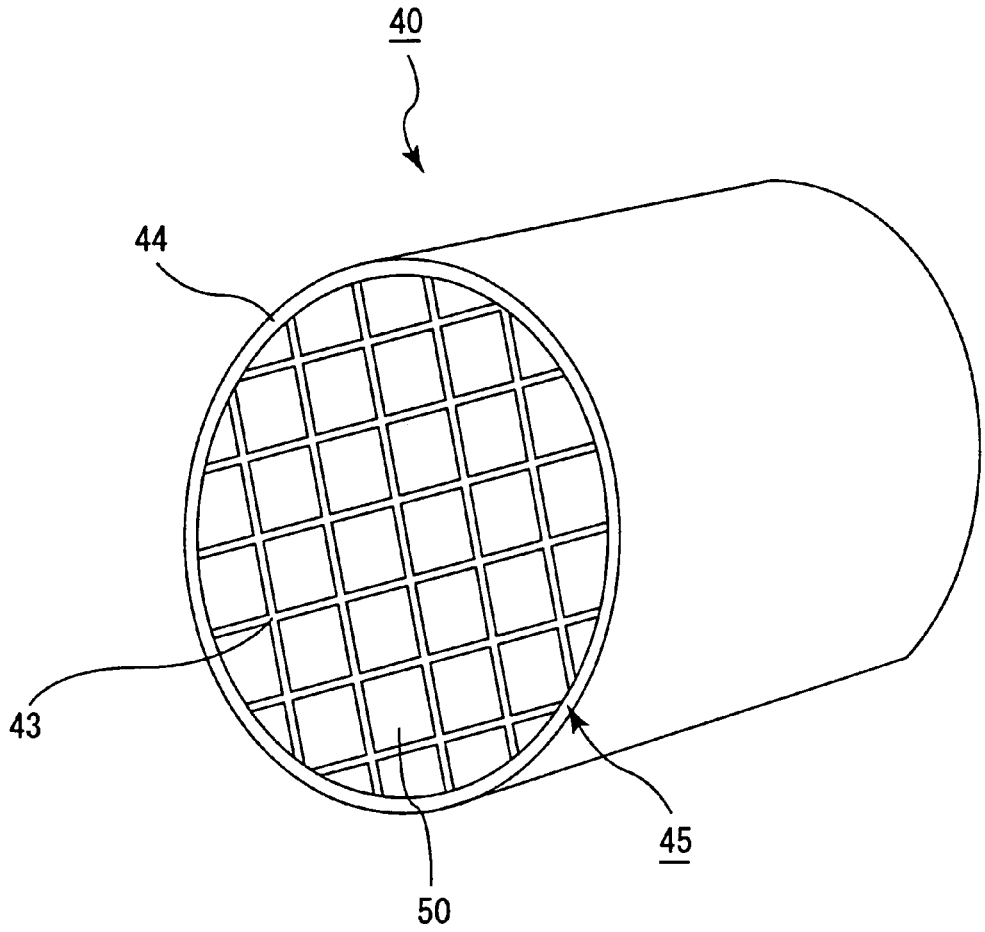
FIG. 3 is a perspective view that schematically shows a honeycomb structural body manufactured by using porous ceramic members.

FIG. 3 is a perspective view that schematically shows one example of a honeycomb structural body.

Figure 4A:
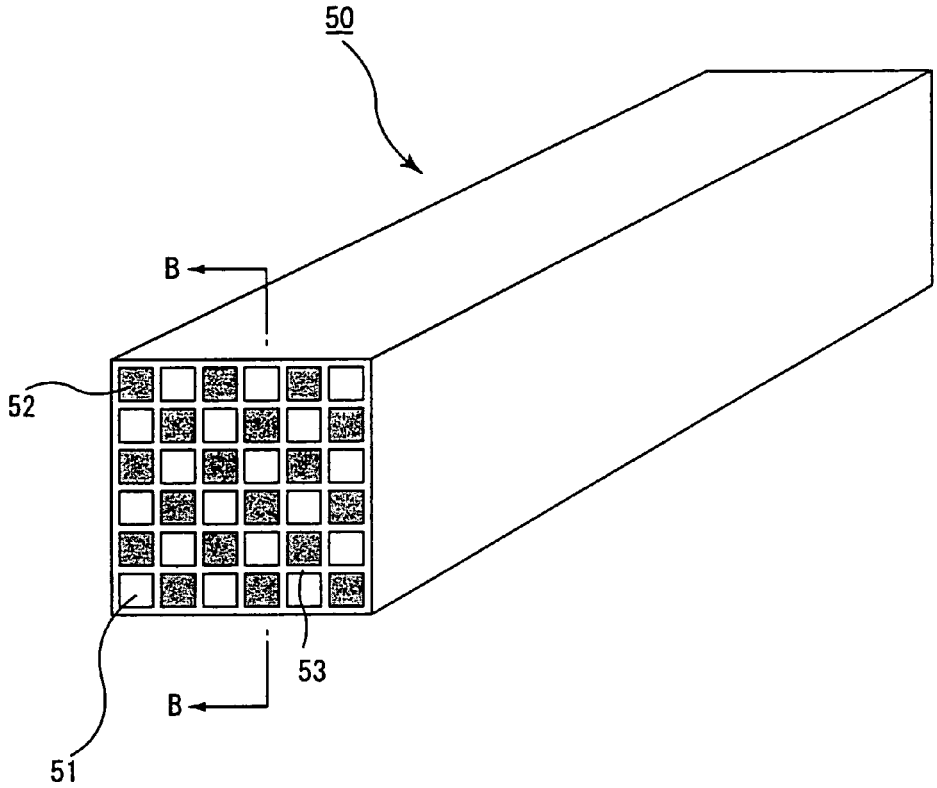
FIG. 4A is a perspective view that schematically shows a porous ceramic member.
Figure 4B:
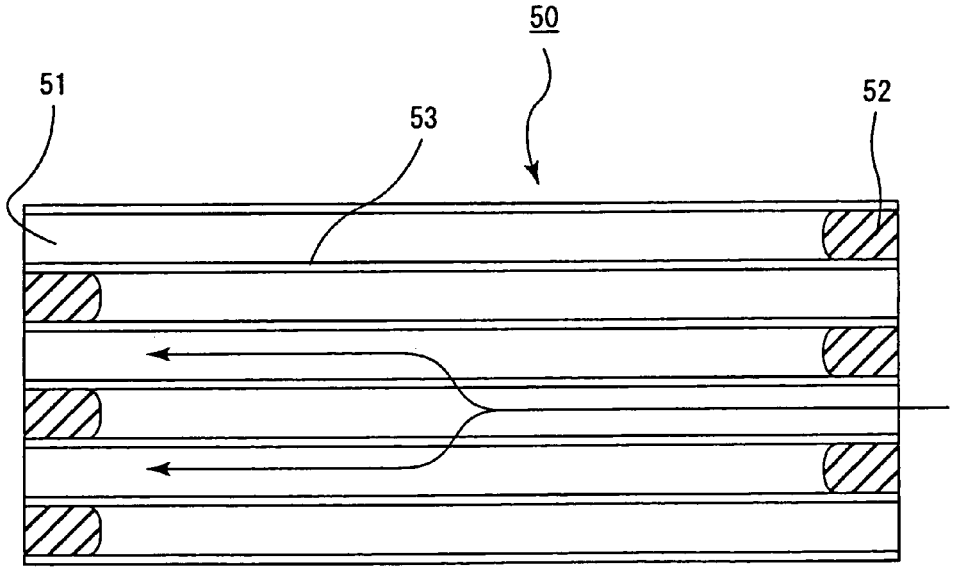
FIG. 4B is a cross-sectional view taken along line B-B.

FIG. 4A is a perspective view that schematically shows a porous ceramic member to be used in the honeycomb structural body shown in FIG. 3, and FIG. 4B is a cross-sectional view taken along line B-B of FIG. 4A.

A honeycomb structural body 40 has a structure that a plurality of porous ceramic members 50 made of a non-oxide ceramic material, such as silicon carbide or the like, are bound to one another through a sealing material layer 43 to form a ceramic block 45 with a sealing material layer 44 formed on the periphery of the ceramic block 45. Moreover, each porous ceramic member 50 has a structure that a large number of through holes 51 are placed in parallel with one another in the length direction with a partition wall 53 interposed therebetween, and the partition wall 53 separating the through holes 51 functions as a filter for collecting particles.

In other words, as shown in FIG. 4B, each of the through holes 51 formed in the honeycomb structural body 50 made of porous silicon carbide is sealed with a plug 52 on either one of the ends on the exhaust gas inlet side or exhaust gas outlet side so that exhaust gases that have entered one of the through holes 51 are allowed to flow out of another through hole 51 after always passing through the corresponding partition wall 53 that separates the through holes 51; thus, when exhaust gases pass through the partition wall 53, particulates are captured by the partition wall 53 so that the exhaust gases are purified.

Since the honeycomb structural body 40 of this type is superior in heat resistance and capable of easily carrying out a regenerating process and the like, it is used in various large-size vehicles, vehicles with diesel engines and the like.

The honeycomb structural body used as such a ceramic filter is referred to as ceramic honeycomb filter.

The sealing material layer 43, which functions as an adhesive layer for bonding the porous ceramic members 50 to each other, may be used as a filter. With respect to the material for the sealing material layer 43, although not particularly limited, approximately the same material as the porous ceramic member 50 may be used.

The sealing material layer 44 is placed so as to prevent exhaust gases from leaking through the peripheral portion of each ceramic block 45 when the honeycomb structural body 40 is installed in an exhaust passage of an internal combustion engine. With respect to the material for the sealing material layer 44 also, although not particularly limited, approximately the same material as the porous ceramic member 50 may be desirably used.

Here, with respect to the porous ceramic member 50, the end portion of each through hole is not necessarily required to be sealed, and in the case of no sealed end portion, it can be used as a catalyst supporting body on which, for example, a catalyst for converting exhaust gases is supported.

The porous ceramic member, which is mainly composed of silicon carbide, may be formed by silicon-containing ceramics in which metal silicon is blended in the silicon carbide, or ceramics which are bonded by silicon and a silicate compound, or may be formed by another material. Upon adding the metal silicon, the amount of addition thereof is desirably set to 0 to about 45% by weight with respect to the total weight.

The average pore diameter of the porous ceramic body 50 is desirably set in a range from about 5 to about 100 μm. The average pore diameter of less than about 5 μm tends to cause clogging of particulates. In contrast, the average pore diameter exceeding about 100 μm tends to cause particulates to pass through the pore, failing to capture particulates, as well as failing to function as a filter.

Although not particularly limited, the porosity of the porous ceramic body 50 is desirably set in a range from about 40 to about 80%. When the porosity is less than about 40%, the porous ceramic body becomes more likely to clogging. In contrast, the porosity exceeding about 80% causes degradation in the strength of the pillar-shaped body; thus, it might be easily broken.

With respect to the particle size of ceramic particles to be used upon manufacturing such a porous ceramic body 50, although not particularly limited, those particle sizes which hardly cause shrinkage in the succeeding sintering process are desirably used, and for example, those particles, prepared by combining 100 parts by weight of ceramic particles having an average particle size of about 0.3 to about 50 μm with about 5 to about 65 parts by weight of ceramic particles having an average particle size of about 0.1 to about 1.0 μm, are desirably used. By mixing ceramic powders having the above-mentioned respective particle sizes at the above-mentioned blending ratio, it is possible to provide a pillar-shaped body made of porous ceramics.

With respect to the shape of the honeycomb structural body 40, not particularly limited to a cylindrical shape, a pillar shape, such as an elliptical cylindrical shape with a flat shape in its cross section, or a rectangular pillar shape may be used.

Here, the honeycomb structural body 40 can be used as a catalyst supporting member, and in this case, a catalyst (catalyst for converting exhaust gases) used for converting exhaust gases is supported on the honeycomb structural body.

By using the honeycomb structural body as a catalyst supporting member, toxic components in exhaust gases, such as HC, CO, NOx and the like, and HC and the like derived from organic components slightly contained in the honeycomb structural body can be positively converted.

With respect to the catalyst for converting exhaust gases, not particularly limited, examples thereof may include noble metals such as platinum, palladium, rhodium and the like. Each of these noble metals may be used alone, or two or more kinds of these may be used in combination.

Next, description will be given of a method for manufacturing a honeycomb structural body.

More specifically, a ceramic piled-up body that forms a ceramic block 45 is first formed (see FIG. 4).

The above-mentioned ceramic piled-up body has a pillar-shaped structure that a plurality of rectangular pillar-shaped porous ceramic members 50 are bound to one another through a sealing material layer 43.

In order to manufacture the porous ceramic member 50 made of silicon carbide, first, a mixed composition is prepared by adding a binder and a dispersant solution to silicon carbide powder, and after this has been mixed by using an attritor or the like, the resulting mixture is sufficiently kneaded by using a kneader or the like so that a pillar-shaped ceramic formed body having approximately the same shape as the porous ceramic member 50 shown in FIG. 4 is formed through an extrusion-forming method or the like.

With respect to the particle size of silicon carbide powder, although not particularly limited, such powder that is less likely to shrink in the succeeding firing process is preferably used and, for example, such powder, prepared by combining 100 parts by weight of silicon carbide powder having an average particle size of about 0.3 to about 50 μm with about 5 to about 65 parts by weight of silicon ceramic powder having an average particle size of about 0.1 to about 1.0 μm, is preferably used.

With respect to the above-mentioned binder, not particularly limited, examples thereof may include methylcellulose, carboxy methylcellulose, hydroxy ethylcellulose, polyethylene glycol, phenolic resins, epoxy resins and the like.

Normally, the blend ratio of the above-mentioned binder is normally set to about 1 to about 10 parts by weight to 100 parts by weight of silicon carbide powder.

With respect to the above-mentioned dispersant solution, not particularly limited, examples thereof may include an organic solvent such as benzene or the like, alcohol such as methanol or the like, water and the like.

An appropriate amount of the above-mentioned dispersant solution is blended so that the viscosity of the mixed composition is set in a predetermined range.

Next, the silicon carbide formed body is dried, and a mouth-sealing process in which plugs are injected into predetermined through holes is carried out if necessary, and the resulting formed body is again subjected to a drying process.

Next, this silicon carbide formed body is heated at about 400 to about 650° C. in an oxygen-containing atmosphere so that a degreasing process is carried out, and heated at about 1400 to about 2200° C. in an inert gas atmosphere, such as a nitrogen gas, an argon gas or the like, so that a firing process is carried out to sinter the ceramic powder, thereby manufacturing a porous ceramic member 50 made of silicon carbide.

Upon carrying out the above-mentioned firing process, the firing furnace according to the present invention is used.

In the firing process, since the heating process is carried out at the above-mentioned temperatures, the conventional firing furnace is subjected to degradation in the heat insulating performance; however, in the present invention, since the stoppers 17 used for fixing a plurality of insulating layers are made of carbon and since layers constituted by the carbon heat insulating layer 130 and the carbon fiber layer 131 are placed as the outermost layer of the heat insulating layer, the same firing furnace is used for a long time, and it becomes possible to provide a porous ceramic member that sufficiently achieves designed performances, under the same conditions with high reproducibility. Moreover, since the firing furnace of the present invention may be prepared as a continuous firing furnace, porous ceramic members 50 can be continuously manufactured. Here, the firing furnace of the present invention may be prepared as a batch firing furnace.

Thereafter, a plurality of the porous ceramic members 50 manufactured through the above-mentioned processes are bound to one another through a sealing material layer 43, and after the resulting body has been machined into a predetermined shape, a sealing material layer 34 is formed on the periphery thereof; thus, manufacturing processes of the honeycomb structural body are completed.

In the above-mentioned embodiment, for example, a manufacturing method of a non-oxide type porous ceramic member has been described; however, with respect to the ceramic material to form the porous ceramic member to be manufactured, not particularly limited to silicon carbide, examples thereof may include: nitride ceramics such as aluminum nitride, silicon nitride, boron nitride, titanium nitride and the like; carbide ceramics such as zirconium carbide, titanium carbide, tantalum carbide, tungsten carbide and the like; oxide ceramics such as alumina, zirconia, cordierite, mullite, silica and the like; and the like. Moreover, the porous ceramic material may be prepared as a material made of two kinds or more of materials, such as: a composite material of silicon and silicon carbide; and aluminum titanate. In the case where the composite material of silicon and silicon carbide is used, silicon is desirably added so that a silicon content is set in a range from 0 to about 45% by weight with respect to the total weight.

According to the manufacturing method of a ceramic member in which the firing furnace of the present invention is used, it becomes possible to manufacture a ceramic member that sufficiently achieves designed performances, under the same conditions with high reproducibility.

In particular, the present invention is suitably applied to non-oxide ceramic members (non-oxide porous ceramic members).

The ceramic member manufactured by using a firing furnace of the present invention sufficiently achieves designed performances.

The ceramic member of the present invention, in the case where it is especially a non-oxide ceramic member (non-oxide porous ceramic member), sufficiently achieves designed performances and has a superior performance as a filter and the like.

The ceramic honeycomb filter of the present invention is manufactured by using the above-mentioned ceramic member, especially the porous ceramic member, so it sufficiently achieves designed performances.

EXAMPLES

In the following, description will be given of the present invention by way of examples in detail; however, the present invention is not intended to be limited only by these examples.

Example 1

(1) A firing furnace as shown in FIG. 1 was formed, and with respect to the heat insulating layers, a layer 13*a* (FR200/OS made by Kureha Chemical Industry Co., Ltd., density: 0.16 g/cm$^3$, thickness: 50 mm), made of a carbon member, was formed as an innermost layer, a layer 13*b* (FR200/OS made by Kureha Chemical Industry Co., Ltd., density: 0.16 g/cm$^3$, thickness: 50 mm), made of a carbon member, was formed as a second layer, and a composite layer (made by Kureha Chemical Industry Co., Ltd.) of a carbon heat insulating material layer 130 (density: 0.16 g/cm$^3$, thickness: 25 mm) and a carbon fiber layer 131 (density: 0.1 g/cm$^3$, thickness: 25 mm) was formed as an outermost layer, and the temperature of the heat insulating layers 13 was measured at each of positions shown in FIG. 2 in a normal-pressure argon atmosphere with the maximum temperature in the muffle being set at 2200° C., by inserting a thermocouple to the portion of the heat insulating member located in the center of the heating chamber.

As a result, the measured temperatures were 2200° C. at a position "a", 1900° C. at a position "b", 1430° C. at a position "c" and 320° C. at a position "d", ensuring sufficient functions as a heat insulating material layer.

Here, with respect to the members forming the heat insulating material layer, any of them had a concentration of impurities of 0.1% by weight or less, and the stoppers 17 made of carbon, which were attached to the heat insulating material layer 13 also had a concentration of impurities of 0.1% by weight or less.

(2) Next, a honeycomb structural body made of porous ceramic members was manufactured by using the above-mentioned firing furnace.

In other words, powder of α-type silicon carbide having an average particle size of 10 μm (60% by weight) and powder of α-type silicon carbide having an average particle size of 0.5 μm (40% by weight) were wet-mixed, and to 100 parts by weight of the resulting mixture were added and kneaded 5 parts by weight of an organic binder (methyl cellulose) and 10 parts by weight of water to obtain a mixed composition. Next, after a slight amount of a plasticizer and a lubricant had been added and kneaded therein, the resulting mixture was extrusion-formed so that a raw formed product was formed.

(3) Next, the above-mentioned raw formed product was dried by using a microwave drier, and predetermined through holes were then filled with a paste having the same composition as the raw formed product, and after having been again dried by using a drier, this was degreased at 400° C., and fired at 2200° C. in a normal-pressure argon atmosphere for 3 hours by using the above-mentioned firing furnace to manufacture a porous ceramic member as shown in FIG. 4, which was made of a silicon carbide sintered body, and had a size of 34 mm×34 mm×300 mm, the number of through holes of 31 pcs/cm$^2$ and a thickness of the partition wall of 0.3 mm.

(4) Thereafter, by using the method described in "DESCRIPTION OF THE EMBODIMENTS", a plurality of the porous ceramic members 50 made of silicon carbide, shown in FIG. 4, were bound to one another through a sealing material layer 43 to form a ceramic block 45, and a sealing material layer 44 was formed on the periphery of this ceramic block 45 so that a honeycomb structural body 40 was manufactured.

(5) Moreover, the processes for manufacturing the porous ceramic member were continuously carried out for 2000 hours by using the above-mentioned firing furnace, and 2000 hours later, the temperature of the heat insulating layer forming the firing furnace was measured in the same manner as the measuring method before the manufacturing processes.

As a result, the measured temperatures were 2200° C. at the position "a", 1920° C. at the position "b", 1450° C. at the position "c" and 350° C. at the position "d"; thus, although slight temperature rises from the start of the manufacturing processes were observed at the positions "b" and "c", there was a sufficient temperature drop at the position "d" so that sufficient functions were obtained as a heat insulating layer. Moreover, after the completion of the manufacturing processes, the heat insulating layer was cut and the side face was observed; however, no change was observed from the initial state of the heat insulating layer in its shape and the like.

Here, with respect to the honeycomb structural bodies 40 thus manufactured, any of them, produced at any time, achieved performances as initially designed.

Comparative Example 1

The same experiment as Example 1 was conducted except that a layer made of alumina fibers (made by Toshiba Ceramics Co., Ltd.; purity of $Al_2O_3$: 95%, 1800° C. fired product, thickness: 50 mm) was used as the outermost layer of the heat insulating layer.

As a result, the temperature distributions of the heat insulating layer before the manufacturing process were 2200° C. at the position "a", 1900° C. at the position "b", 1440° C. at the position "c" and 320° C. at the position "d", and the temperature distributions 2000 hours after the start of the manufacturing processes were 2200° C. at the position "a", 1960° C. at the position "b", 1550° C. at the position "c" and 400° C. at the position "d"; thus, temperature rises were observed at the positions "b" and "c", in comparison with the temperatures before the start of the manufacturing processes, and even at the position "d", the temperature was not sufficiently lowered, resulting in degradation in performances of the heat insulating layer.

Moreover, when, after the completion of the manufacturing processes, the heat insulating layer was observed to find a gap between the second heat insulating layer and the third heat insulating layer (outermost layer). Presumably, this gap was caused by a reaction between the second carbon member layer and the third ceramic fiber layer. Moreover, the third heat insulating layer was deformed. The deformation is presumably caused by softened alumina fibers due to extremely high temperatures of the third heat insulating layer. Moreover, with respect to the stoppers that were made of carbon, and used for fixing the heat insulating layers, those having cracks and disconnections were found.

With respect to the honeycomb structural bodies thus manufactured, slight changes in performances were found depending on manufactured times. These changes were presumably caused by slight changes in the temperature or the like on the periphery of the formed body to be manufactured in the firing furnace.

As clearly indicated by the above-mentioned examples, the present invention is suitably applicable to a non-oxide type porous ceramic member, in particular, to a porous ceramic member made of silicon carbide.

What is claimed as new and desired to be secured by Letters Patent of the United States is:

1. A manufacturing method for producing a ceramic member in a firing furnace including a muffle and a space for housing a formed body to be fired inside the muffle, a heater or a heat generator serving as the heater and placed outside the muffle, and a plurality of heat insulating carbon layers, fixed by carbon stoppers, and enclosing said heater or said heat generator, said method comprising:

a step of firing the formed body with the firing furnace to form said ceramic member; and a step of heating said muffle and said space for housing the formed body while suppressing with said plurality of heat insulating carbon layers a temperature increase on outer ones of the heat insulating carbon layers and while fixing the plurality of heat insulating carbon layers with the carbon stoppers.

2. The manufacturing method of a ceramic member according to claim 1, wherein said ceramic member is a porous ceramic member.

3. The manufacturing method of a ceramic member according to claim 1, wherein any one layer of the heat insulating carbon layers is a carbon fiber layer.

4. The manufacturing method of a ceramic member according to claim 1, wherein a carbon fiber layer is formed as the outermost layer of said heat insulating carbon layers.

5. The manufacturing method of a ceramic member according to claim 1, wherein each of said heat insulating carbon layers comprises three heat insulating layers.

6. The manufacturing method of a ceramic member according to claim 5, wherein the outermost layer of said heat insulating carbon layers comprises a carbon heat insulating layer and a carbon fiber layer.

7. The manufacturing method of a ceramic member according to claim 6, wherein said carbon heat insulating layer has a density of at least about 0.1 g/cm$^3$ and at most about 5 g/cm$^3$ and a thickness of at least about 5 mm and at most about 100 mm.

8. The manufacturing method of a ceramic member according to claim 6, wherein said carbon fiber layer has a density of at least about 0.05 g/cm$^3$ and at most about 5 g/cm$^3$ and a thickness of at least about 1 mm and at most about 100 mm.

* * * * *

UNITED STATES PATENT AND TRADEMARK OFFICE

CERTIFICATE OF CORRECTION

PATENT NO. : 7,491,057 B2
APPLICATION NO. : 11/174483
DATED : February 17, 2009
INVENTOR(S) : Takamitsu Saijo et al.

It is certified that error appears in the above-identified patent and that said Letters Patent is hereby corrected as shown below:

Title page, item (54), please change:

"FIRING FURNACE, MANUFACTURING METHOD OF A CERAMIC MEMBER USING THE FIRING FURNACE, CERAMIC MEMBER, AND CERAMIC HONEYCOMB FILTER" to --MANUFACTURING METHOD OF A CERAMIC MEMBER USING A FIRING FURNACE--

Column 1, line 1, please change:

"FIRING FURNACE, MANUFACTURING METHOD OF A CERAMIC MEMBER USING THE FIRING FURNACE, CERAMIC MEMBER, AND CERAMIC HONEYCOMB FILTER" to --MANUFACTURING METHOD OF A CERAMIC MEMBER USING A FIRING FURNACE--

Signed and Sealed this

Second Day of June, 2009

John Doll

JOHN DOLL
*Acting Director of the United States Patent and Trademark Office*